US008778855B2

(12) United States Patent
Ichihashi

(10) Patent No.: US 8,778,855 B2
(45) Date of Patent: Jul. 15, 2014

(54) LUBRICATING OIL COMPOSITION FOR CONTINUOUSLY VARIABLE TRANSMISSIONS

(75) Inventor: Toshihiko Ichihashi, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 605 days.

(21) Appl. No.: 12/528,804

(22) PCT Filed: Feb. 6, 2008

(86) PCT No.: PCT/JP2008/051910

§ 371 (c)(1), (2), (4) Date: Aug. 27, 2009

(87) PCT Pub. No.: WO2008/111341

PCT Pub. Date: Sep. 18, 2008

(65) Prior Publication Data

US 2010/0105588 A1 Apr. 29, 2010

(30) Foreign Application Priority Data

Mar. 14, 2007 (JP) ..... 2007-064863

(51) Int. Cl.
*C10M 159/24* (2006.01)
*C10M 169/04* (2006.01)
*C10M 135/10* (2006.01)

(52) U.S. Cl.
USPC ..... 508/391; 508/408; 508/564

(58) Field of Classification Search
None
See application file for complete search history.

(56) References Cited

U.S. PATENT DOCUMENTS

| | | | | |
|---|---|---|---|---|
| 5,792,731 | A | 8/1998 | Ichihashi et al. | |
| 6,426,323 | B1 * | 7/2002 | Sato et al. | 508/371 |
| 2003/0013619 | A1 * | 1/2003 | Sato et al. | 508/192 |
| 2003/0171228 | A1 * | 9/2003 | Deckman et al. | 508/460 |
| 2004/0005988 | A1 | 1/2004 | Watanabe et al. | |
| 2004/0132629 | A1 * | 7/2004 | Vinci et al. | 508/470 |
| 2005/0176593 | A1 | 8/2005 | Ward et al. | |
| 2007/0042918 | A1 | 2/2007 | Yanagi et al. | |

FOREIGN PATENT DOCUMENTS

| | | |
|---|---|---|
| JP | 3 39400 | 2/1991 |
| JP | 7 268375 | 10/1995 |
| JP | 9 100487 | 4/1997 |
| JP | 10 306292 | 11/1998 |
| JP | 2000 1687 | 1/2000 |
| JP | 2000 109867 | 4/2000 |
| JP | 2001 323292 | 11/2001 |
| JP | 2001 342485 | 12/2001 |
| JP | 2001 342486 | 12/2001 |
| JP | 2005 524758 | 8/2005 |
| JP | 2005 281474 | 10/2005 |
| JP | 2006 152092 | 6/2006 |
| JP | 2006 206924 | 8/2006 |
| JP | 2007 217596 | 8/2007 |
| JP | 2007 238721 | 9/2007 |
| WO | 00 29523 | 5/2000 |

* cited by examiner

*Primary Examiner* — Pamela H Weiss
(74) *Attorney, Agent, or Firm* — Oblon, Spivak, McClelland, Maier & Neustadt, L.L.P.

(57) ABSTRACT

A lubricating base oil contains: an overbased calcium sulfonate having a different base number provided such that a total base number is in a range of 280 to 500 mgKOH/g and a calcium concentration in a total amount is in a range of 280 to 3000 mass ppm (in terms of calcium); and orthophosphates that is at least one selected from phosphates and acid phosphates and provided such that a phosphorus concentration is 50 mass ppm or more. A high friction coefficient of 0.11 or more and a favorable wear resistance of a specific wear rate of less than $2.0\times10^{-8}$ $mm^3/Nm$ are obtained, thereby reliably providing a high power transmission capacity for a long period of time, particularly in a belt-type continuously variable transmission equipped with a metallic belt.

6 Claims, No Drawings

LUBRICATING OIL COMPOSITION FOR CONTINUOUSLY VARIABLE TRANSMISSIONS

CROSS-REFERENCE TO RELATED APPLICATIONS

This application is a National Stage of PCT/JP08/051,910 filed Feb. 6, 2008 and claims the benefit of JP 2007-064863 filed Mar. 14, 2007.

TECHNICAL FIELD

The present invention relates to a lubricating oil composition used for a continuously variable transmission.

BACKGROUND ART

Typically known continuously variable transmissions (CVT) include a variety of types such as a metallic belt type, a chain type and a traction drive type. Any type of CVT is required to provide a high power transmission capacity. Performance of the CVT depends on features of a lubricating oil to be used, i.e., a friction coefficient between metals or a traction coefficient. The larger both coefficients become, the higher the power transmission capacity becomes.

Accordingly, various lubricating oil compositions for the continuously variable transmissions that can favorably transmit power with a large capacity are known (see, for example, Patent Documents 1 to 5).

Patent Document 1 discloses that a sulfuric extreme pressure agent, a phosphorus extreme pressure agent and an alkaline earth metal detergent are added to a lubricating base oil so as to provide excellent wear resistance and extreme-pressure property, retain a high friction coefficient for a long period of time and transmit a large amount of torque.

Patent Document 2 discloses that a calcium sulfonate having a total base number of 50 to 100 mg KOH/g and a phosphite ester are added to a base oil so as to prolong a life of an anti-shudder property (shudder is vibration occurring at a time of lockup) in an automatic transmission equipped with a slip-lockup mechanism and enhance a long-lasting life of a scratch-noise prevention property in a belt-type continuously variable transmission.

Patent Document 3 discloses that a metal detergent such as calcium and a phosphorus anti-wear agent are added to a lubricating base oil so as to provide a high friction coefficient between metals and an excellent anti-friction property to a belt and a pulley in a push-belt-type continuously variable transmission. The metal detergent is added so that a ratio between a metal content in a total weight of a lubricating oil composition and a total base number is in a range of 0.75 to 4.5. The phosphorus anti-wear agent is added so that a ratio between a content of metal such as calcium derived from the metal detergent and a phosphorus content is in a range of 0.5 to 2.0.

Patent Document 4 discloses that a phosphate ester having an alkyl group containing a thioether bond and one or more selected from the group of a phosphate ester, an amine salt thereof and an overbased calcium sulfonate are added to a base oil so as to improve and stabilize a power transmission capacity, the base oil including a hydrocarbon compound having a cohesive energy density of 0.180 GPa or more at 40 degrees C. to have a kinematic viscosity of 5 to 150 $mm^2/s$ at 40 degrees C.

Patent Document 5 discloses that a lubricating base oil, a phosphorus compound, and at least one organic acid salt selected from the group of an alkaline earth metal sulfonate, an alkaline earth metal phenate and an alkaline earth metal salicylate are mixed so as to retain a sufficient wear resistance and a high anti stick-slip property for a long period of time. A content of the phosphorus compound in a total amount of a composition is in a range of 0.01 to 0.2 (in terms of phosphorus), a content of the organic acid salt in the total amount of the composition is in a range of 0.01 to 0.2 (in terms of alkaline earth metal) and a ratio of phosphorus to alkaline earth metal is in a range of 0.1 to 10.

Patent Document 1: JP-A-9-100487
Patent Document 2: JP-A-10-306292
Patent Document 3: JP-A-2001-342485
Patent Document 4: JP-A-2005-281474
Patent Document 5: JP-A-2006-152092

DISCLOSURE OF THE INVENTION

Problems to be Solved by the Invention

Recently, it has been attempted to improve fuel efficiency for reducing carbon dioxides emission from automobiles. Accordingly, further increase in a power transmission capacity has been demanded in a continuously variable transmission.

With consideration for these points, an object of the invention is to provide a lubricating oil composition for a continuously variable transmission which has a high friction coefficient between metals and favorable wear resistance and reliably provides a high power transmission capacity in the continuously variable transmission.

Means for Solving the Problems

A lubricating oil composition for a continuously variable transmission according to an aspect of the invention includes: a lubricating base oil; an overbased calcium sulfonate having a base number of 280 mgKOH/g to 500 mgKOH/g; and orthophosphates added at a content of 0.03 mass % to 3 mass % of a total amount.

In the above aspect of the invention, the lubricating base oil is added with the overbased calcium sulfonate having the base number of 280 mgKOH/g to 500 mgKOH/g (preferably in a range of 290 mgKOH/g to 450 mgKOH/g) and orthophosphates.

Accordingly, a lubricating film is formed on a friction surface by an additive and a high friction coefficient between metals of 0.11 or more and a favorable wear resistance of a specific wear rate of less than $2.0\times10^{-8}$ $mm^3/Nm$ are obtained, whereby a stable and high power transmission capacity in the continuously variable transmission is obtained.

When the base number of the overbased calcium sulfonate is less than 280 mgKOH/g, the friction coefficient is high, but wear may be increased. On the other hand, when the base number exceeds 500 mgKOH/g, the overbased calcium sulfonate may not be dispersed in oil or wear may be increased. Accordingly, the base number of the overbased calcium sulfonate to be used is in a range of 280 mgKOH/g to 500 mgKOH/g, preferably in a range of 290 mgKOH/g to 450 mgKOH/g.

In the aspect of the invention, the overbased calcium sulfonate is preferably mixed such that a calcium concentration in the total amount is in a range of 280 mass ppm to 3000 mass ppm.

In the above aspect of the invention, the overbased calcium sulfonate is mixed such that the calcium concentration in the total amount is in a range of 280 mass ppm to 3000 mass ppm, preferably in a range of 300 mass ppm to 600 mass ppm.

Accordingly, a lubricating film is formed for protecting a metallic surface and a high friction coefficient between metals and a low friction resistance are easily obtained, thereby facilitating a stable and high power transmission capacity in the continuously variable transmission. When the calcium concentration in the total amount is less than 280 mass ppm, the friction coefficient may be decreased. On the other hand, when the calcium concentration in the total amount is more than 3000 mass ppm, wear may be increased. Accordingly, the overbased calcium sulfonate is mixed such that the calcium concentration in the total amount is in a range of 280 mass ppm to 3000 mass ppm, preferably in a range of 300 mass ppm to 600 mass ppm.

In the aspect of the invention, the overbased calcium sulfonate is preferably a combination of a plurality of overbased calcium sulfonates having different base numbers.

In the above aspect of the invention, the plurality of overbased calcium sulfonates having different base numbers, e.g., an overbased calcium sulfonate having a base number of 300 and an overbased calcium sulfonate having a base number of 400, are combined such that the total base number is in a range of 280 mgKOH/g to 500 mgKOH/g.

Accordingly, the overbased calcium sulfonate is easily mixed such that the calcium concentration in the total amount is in a range of 280 mass ppm to 3000 mass ppm, preferably in a range of 300 mass ppm to 600 mass ppm, thereby facilitating a stable and high power transmission capacity in the continuously variable transmission.

In the aspect of the invention, the overbased calcium sulfonate is preferably mixed such that a calcium concentration is 1.5 times or less of a total phosphorus concentration.

In the above aspect of the invention, the overbased calcium sulfonate is mixed so that the calcium concentration is 1.5 times or less of the total phosphorus concentration.

Accordingly, a lubricating film is formed and a high friction coefficient between metals of 0.11 or more and a favorable wear resistance of a specific wear rate of less than $2.0\times10^{-8}$ $mm^3/Nm$ are obtained at a favorable ratio between calcium and phosphorus, whereby a stable and high power transmission capacity is obtained in the continuously variable transmission.

When the calcium concentration exceeds 1.5 times of the total phosphorus concentration, the friction coefficient may be decreased. Accordingly, the overbased calcium sulfonate is mixed at the calcium concentration of 1.5 times or less of the total phosphorus concentration.

In the aspect of the invention, the orthophosphates are preferably at least one selected from phosphates and acid phosphates.

In the above aspect of the invention, at least one selected from phosphates and acid phosphates is used as orthophosphates.

Accordingly, a relatively hard lubricating film is formed and a specific advantage that wear resistance is provided and a friction coefficient is enhanced is obtained.

In the aspect of the invention, the orthophosphates are preferably mixed at a phosphorus concentration of 50 mass ppm or more.

In the above aspect of the invention, orthophosphates are mixed such that the phosphorus concentration is 50 mass ppm or more, preferably in a range of 150 mass ppm to 1000 mass ppm.

Thus, a lubricating film is modified to provide high friction.

When the phosphorus concentration is less than 50 mass ppm, the lubricating film may not be sufficiently modified. Accordingly, orthophosphates are mixed such that the phosphorus concentration is 50 mass ppm or more, preferably in a range of 150 mass ppm to 1000 mass ppm. Besides orthophosphates, other phosphorus compounds such as phosphite diester may be added.

In the aspect of the invention, the lubricating base oil is preferably at least either one selected from a mineral oil and a synthetic oil, both of the mineral oil and the synthetic oil having a saturated hydrocarbon component of 90 mass % or more, a sulfur component of 0.03 mass % or less and the viscosity index of 100 or more.

In the above aspect of the invention, at least one of the mineral oil and the synthetic oil is used as the lubricating base oil, the mineral oil and synthetic oil having the saturated hydrocarbon component of 90 mass % or more, the sulfur component of 0.03 mass % or less and the viscosity index of 100 or more.

Thus, degraded products can be less produced and a favorable friction property is maintainable for a long period of time.

When the saturated hydrocarbon component is less than 90 mass %, degraded products may be more produced. When the sulfur component is more than 0.03 mass %, degraded products may be more produced. Further, when the viscosity index is less than 100, wear at a high temperature may be increased. Accordingly, at least one of the mineral oil and the synthetic oil is preferably used as the lubricating base oil, the mineral oil and the synthetic oil having the saturated hydrocarbon component of 90 mass % or more, the sulfur component of 0.03 mass % or less and the viscosity index of 100 or more.

In the above aspect of the invention, the continuously variable transmission is preferably a belt-type continuously variable transmission equipped with a metallic belt.

In the above aspect of the invention, the lubricating oil composition is preferably applied to the belt-type continuously variable transmission equipped with the metallic belt.

Thus, wear resistance is excellent and a friction coefficient is high, whereby a highly efficient power transmission is provided for a long period of time.

BEST MODE FOR CARRYING OUT THE INVENTION

A preferred exemplary embodiment for implementing the invention will be described below.

In this exemplary embodiment, the lubricating oil composition is exemplarily applied to a belt-type continuously variable transmission equipped with a metallic belt, but such an application is not limitative. For example, the invention can be used for various continuously variable transmissions such as a chain type continuously variable transmission equipped with a chain and a traction-drive type continuously variable transmission equipped with a traction drive.

[Arrangement of Lubricating Oil Composition for Continuously Variable Transmissions]

A lubricating oil composition for a continuously variable transmission in this exemplary embodiment is favorably used for various continuously variable transmission, particularly, a belt-type continuously variable transmission equipped with a metallic belt.

The lubricating oil composition for the continuously variable transmission includes: (A) a lubricating base oil; (B) an overbased calcium sulfonate having a base number of 280 mgKOH/g to 500 mgKOH/g; and (C) orthophosphates.

(Component A: Lubricating Base Oil)

As the lubricating base oil, at least one of a mineral oil and a synthetic oil may be used alone or in a combination of two types or more, or a combination of the mineral oil and the synthetic oil may be used.

Any typical base oil for transmission may be used as the mineral oil and the synthetic oil, which is not particularly limitative. However, for example, the base oil preferably has a kinematic viscosity of 1 $mm^2/s$ to 50 $mm^2/s$ at 100 degrees C., particularly of 2 $mm^2/s$ to 15 $mm^2/s$. When the kinematic viscosity is too high, a low temperature viscosity may be deteriorated. When the kinematic viscosity is too low, wear at a sliding portion such as a gear bearing and a clutch in the continuously variable transmission may be increased. Accordingly, the base oil having a kinematic viscosity of 1 $mm^2/s$ to 50 $mm^2/s$ at 100 degrees C. is preferably used, particularly a kinematic viscosity of 2 $mm^2/s$ to 15 $mm^2/s$.

A pour point, which is an index of a low temperature fluidity of the lubricating base oil, is not limited, but is preferably minus 10 degrees C. or lower, particularly minus 15 degrees C. or lower.

The lubricating base oil is not particularly limited, but preferably has the saturated hydrocarbon component of 90 mass % or more, the sulfur component of 0.03 mass % or less and the viscosity index of 100 or more. When the saturated hydrocarbon component is less than 90 mass %, degraded products may be increased. Moreover, when the sulfur component is more than 0.03 mass %, degraded products may be increased. Further, when the viscosity index is less than 100, wear at a high temperature may be increased. Consequently, the mineral oil and synthetic oil having the saturated hydrocarbon component of 90 mass % or more, the sulfur component of 0.03 mass % or less and the viscosity index of 100 or more may be preferably used.

Examples of the mineral oil may include: a paraffinic mineral oil, an intermediate base mineral oil and a naphthenic mineral oil. Specifically, the mineral oil is exemplified by a light neutral oil, a medium neutral oil, a heavy neutral oil, bright stock and the like that are produced by solvent purification or hydrogenation purification.

Examples of the synthetic oil may include: poly-α-olefins, α-olefin copolymers, polybuten, alkyl benzene, polyol esters, diacid esters, polyoxyalkylene glycol, polyoxyalkylene glycol esters, polyoxyalkylene glycol ethers, hindered esters, silicone oil and the like. Polyolefins and polyol esters are particularly preferable.

(Component B: Overbased Calcium Sulfonate)

The overbased calcium sulfonate is calcium metal salts of various sulfonic acids and can be typically obtained by a method of carbonating calcium metal salts of various sulfonic acids as represented by Chemical Formula 1 below.

Examples of the sulfonic acid may include: an aromatic petroleum sulfonate, an alkyl sulfonate, aryl sulfonate, alkyl aryl sulfonate and the like. Specifically, the sulfonic acid is exemplified by dodecyl benzene sulfonate, dilauryl cetyl benzene sulfonate, paraffin wax substituted benzene sulfonate, polyolefin substituted benzene sulfonate, polyisobutylene substituted benzene sulfonate, naphthalene sulfonate and the like.

[Chemical Formula 1]

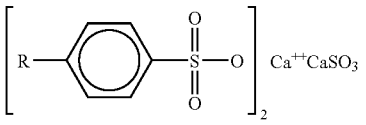

A total base number of the overbased calcium sulfonate is in a range of 280 mgKOH/g to 500 mgKOH/g. When the base number is less than 280 mgKOH/g, a friction coefficient is high but wear may be increased. On the other hand, when the base number is more than 500 mgKOH/g, wear may be increased. Accordingly, the base number of the overbased calcium sulfonate to be added is in a range of 280 mgKOH/g to 500 mgKOH/g, preferably in a range of 290 mgKOH/g to 450 mgKOH/g. The base number is measured based on JIS (Japanese Industrial Standard)-K-2501 (perchloric acid method).

The overbased calcium sulfonate is preferably a combination of a plurality of overbased calcium sulfonates having different base numbers. For example, two overbased calcium sulfonates having a base number of 300 and a base number of 400 are combined such that the total base number becomes in a range of 280 mgKOH/g to 500 mgKOH/g. Thus, by combining the overbased calcium sulfonates having different base numbers, an additive film of strong wear resistance is formed and specific advantages such as a high friction coefficient and an excellent wear resistance are favorably obtained.

The overbased calcium sulfonate is preferably mixed such that a calcium concentration in a total amount of the lubricating oil composition for the continuously variable transmission in terms of calcium is in a range of 280 mass ppm to 3000 mass ppm, particularly, in a range of 300 mass ppm to 600 mass ppm. When the calcium concentration in the total amount is less than 280 mass ppm, the friction coefficient may be decreased. On the other hand, when the calcium concentration in the total amount is more than 3000 mass ppm, the friction coefficient may be increased. Accordingly, the overbased calcium sulfonate is preferably mixed such that the calcium concentration in the total amount is in a range of 280 mass ppm to 3000 mass ppm, particularly in a range of 300 mass ppm to 600 mass ppm.

Moreover, the overbased calcium sulfonate is mixed such that the calcium concentration is 1.5 times (in terms of calcium) higher than the phosphorus concentration in the lubricating oil composition for the continuously variable transmission. When the calcium concentration exceeds 1.5 times higher than the total phosphorus concentration, the friction coefficient may be decreased. Accordingly, the overbased calcium sulfonate is mixed such that the calcium concentration is 1.5 times or less of the total phosphorus concentration, preferably in a range of 0.5 to 1.2 times.

(Component C: Orthophosphates)

As orthophosphates, as represented by Chemical Formula 2 below, at least one of phosphates and acid phosphates may be used alone or in a combination of two or more, or a combination of phosphates and acid phosphates may be used.

Phosphates may be exemplified by tricresyl phosphate.

Acid phosphates may be exemplified by di-2-ethylhexyl acid phosphate.

[Chemical Formula 2]

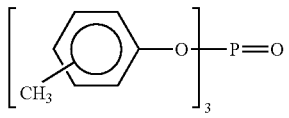

Orthophosphates are mixed in a range of 0.03 mass % to 3 mass % of a total amount of the composition, preferably in a range of 0.08 mass % to 8 mass % or less. When an amount of orthophosphates is less than 0.03 mass %, the friction coefficient may be decreased. On the other hand, when the amount of orthophosphates exceeds 3 mass %, wear may be increased.

Orthophosphates are preferably mixed such that the phosphorus concentration is 50 mass ppm or more, preferably in a range of 150 mass ppm to 1000 mass ppm. When the phosphorus concentration is less than 50 mass ppm, the friction coefficient may be decreased. This phosphorus concentration is a concentration of phosphorus derived from orthophosphates. As noted in detail below, phosphorus in the lubricating oil composition for the continuously variable transmission may also include phosphorus derived from an additive. In other words, a phosphorus compound such as phosphite diester other than the orthophosphate may be added.

(Additives)

The lubricating oil composition for the continuously variable transmission may be added with an additive unless the object of the invention is disturbed. In other words, as long as the lubricating oil composition for the continuously variable transmission with the high friction coefficient between metals and favorable wear resistance are provided, and the high power transmission capacity is reliably obtained in the continuously variable transmission.

Examples of the additive may include: an antioxidant; an ashless dispersant; a metal deactivator; an antifoaming agent; a viscosity index improver; a pour point depressant; a surfactant; a coloring agent and the like.

The metal deactivator is exemplified by benzotriazole and thiadiazole, which may be used alone or in a combination of two or more. The metal deactivators are typically mixed at a ratio of 0.01 to 5 mass %.

Examples of the antioxidant may include: an amine antioxidant such as alkylated diphenylamine, phenyl-α-naphthylamine and alkylated-α-naphthylamine; dialkyl thiodipropionate; a dialkyldithiocarbamate derivative (excluding a metal salt); bis(3,5-di-t-butyl-4-hydroxybenzil)sulfide; mercaptobenzothiazole; a reactant of phosphorus pentasulfide and olefin; and a sulfuric antioxidant such as dicetyl sulfide. These antioxidants may be used alone or in a combination of two or more. Particularly, the antioxidant of hindered phenol type and amine type or zinc alkyldithiophosphate may be preferably used. The antioxidants are typically mixed at a ratio of 0.05 mass % to 3 mass %.

Examples of the ashless dispersant may include: polyalkenylimides; benzil amines; succinimides; boron containing succinimides; succinates; and monovalent or divalent carboxylic amides represented by fatty acid or succinic acid. These ashless dispersants may be used alone or in a combination of two or more. The ashless dispersants are typically mixed at a ratio of 0.05 mass % to 5 mass %.

Examples of the antifoaming agent may include a silicone compound, an ester compound and the like, which may be used alone or in a combination of two or more. These antifoaming agents are typically mixed at a ratio of 0.05 mass % to 5 mass %.

Examples of the viscosity index improver may include: polymethacrylate; an olefin copolymer such as an ethylene-propylene copolymer; a dispersed olefin copolymer; a styrene copolymer such as a hydrogenated styrene-diene copolymer. The viscosity index improvers may be used alone or in a combination of two or more. The viscosity index improvers are typically mixed at a ratio of 0.01 mass % to 10 mass %.

The pour point depressant may be exemplified by polymethacrylate. The pour point depressant is typically mixed at a ratio of 0.01 mass % to 10 mass %.

The surfactant may be exemplified by polyoxyethylene alkylphenyl ether. The surfactant is typically mixed at a ratio of 0.01 mass % to 10 mass %.

[Advantages of Lubricating Oil Composition for Continuously Variable Transmissions]

According to the above exemplary embodiment, the lubricating base oil is added with the overbased calcium sulfonate having the base number of 280 mgKOH/g to 500 mgKOH/g, preferably of 290 mgKOH/g to 450 mgKOH/g and the orthophosphate.

Consequently, a high friction coefficient and an excellent wear resistance, i.e., a high friction coefficient between metals of 0.11 or more and a favorable wear resistance of a specific wear rate of less than $2.0\times10^{-8}$ $mm^3/Nm$, are obtained, so that a stable and high power transmission capacity is obtained in the continuously variable transmission. The lubricating oil composition is particularly suitable for a belt-type continuously variable transmission equipped with a metallic belt.

In the above exemplary embodiment, the overbased calcium sulfonate is mixed such that the calcium concentration in the total amount is in a range of 280 mass ppm to 3000 mass ppm, preferably in a range of 300 mass ppm to 600 mass ppm.

Accordingly, the high friction coefficient between metals and a low friction resistance are easily obtained, whereby a stable and high power transmission capacity is facilitated in the continuously variable transmission.

In the above exemplary embodiment, the plurality of overbased calcium sulfonates having different base numbers, e.g., an overbased calcium sulfonate having a base number of 300 and an overbased calcium sulfonate having a base number of 400, are combined such that the total base number is in a range of 280 mgKOH/g to 500 mgKOH/g.

Consequently, by adding the overbased calcium sulfonate having the high friction coefficient and the excellent wear resistance such that the calcium concentration in the total amount is in a range of 280 mass ppm to 3000 mass ppm, preferably in a range of 300 mass ppm to 600 mass ppm, the stable and high power transmission capacity in the continuously variable transmission is easily obtained.

Further, in the above exemplary embodiment, the overbased calcium sulfonate is mixed at the calcium concentration of 1.5 times or less of the total phosphorus concentration (in term of calcium).

Accordingly, a relatively hard lubricating film having wear resistance is formed on a friction surface. At a favorable ratio between calcium and phosphorus, the high friction coefficient between metals of 0.11 or more and the favorable wear resistance of a specific wear rate of less than $2.0\times10^{-8}$ $mm^3/Nm$ are obtained, thereby providing a stable and high power transmission capacity in the continuously variable transmission.

In the above exemplary embodiment, at least one selected from phosphates and acid phosphates is used as orthophosphates.

Accordingly, the lubricant film having wear resistance is formed on the friction surface, thereby providing an excellent wear resistance and a high friction coefficient.

In the above exemplary embodiment, orthophosphates are mixed such that the phosphorus concentration is 50 mass ppm or more, preferably in a range of 150 mass ppm to 1000 mass ppm.

Accordingly, the lubricating film having wear resistance is highly frictioned and an excellent wear resistance and a high friction coefficient are obtained, resulting in forming the lubricating film having high friction coefficient and wear resistance.

In the above exemplary embodiment, at least either one of a mineral oil and a synthetic oil, both of which have the saturated hydrocarbon component of 90 mass % or more, the sulfur component of 0.03 mass % or less and the viscosity index of 100 or more, is used as the lubricating base oil.

Thus, excellent oxidation stability, a high friction coefficient stabilized for a long period of time and excellent wear resistance are specifically obtained.

Modification of Embodiments

It should be noted that the embodiment described above is only an exemplary embodiment of the invention. The invention is not limited to the above-described embodiment but includes modifications and improvements as long as the object and the advantages of the aspect of the invention can be attained. Further, the specific arrangements and configurations may be altered in any manner as long as the modifications and improvements are compatible with the invention.

In other words, the lubricating oil composition used for the continuously variable transmission according to the aspect of the invention is not limitedly used for the belt-type continuously variable transmission equipped with a metallic belt as noted above, but is applicable for various continuously variable transmissions of a chain type, a traction-drive type and the like.

The overbased calcium sulfonate is not limitedly mixed such that the calcium concentration in the total amount is in a range of 280 mass ppm to 3000 mass ppm, but may be mixed such that the calcium concentration in the total amount is less than 280 mass ppm or more than 3000 mass ppm. Moreover, the overbased calcium sulfonate is not limited to the combination of the plurality of overbased calcium sulfonates having the different base numbers in use, but one of the overbased calcium sulfonate may be singularly used. Further, the overbased calcium sulfonate is not limitedly mixed so that the calcium concentration becomes 1.5 times higher than the total phosphorus concentration, but may be mixed so that the calcium concentration becomes less than 1.5 times.

Orthophosphates are not limitedly mixed such that the phosphorus concentration becomes 50 mass ppm or more in terms of phosphorus, but may be mixed so that the phosphorus concentration becomes less than 50 mass ppm.

The lubricating base oil is not limited to the above-mentioned compositions, but any of mineral oils and synthetic oils applicable to the continuously variable transmission may be used.

EXAMPLES

Hereinafter, the invention will be described in more detail below with reference to examples and comparatives.

The invention should not be construed as limited to what is described in the examples and the like.

Examples 1 to 3 and Comparatives 1 to 5

Experiments were carried out to confirm the properties of the lubricating compositions for continuously variable transmissions in the above-mentioned exemplary embodiment. In the experiments, as shown in a blending table of Table 1 below, various lubricating oil compositions were prepared. Properties tests for respective compositions were conducted to measure a friction coefficient and a specific wear rate and then results thereof were comparatively evaluated.

The lubricating base oil of the component A was paraffinic highly-purified mineral oil (trade name: 90N).

The overbased calcium sulfonates of the component B were (B1) the overbased calcium sulfonate having a calcium concentration of 15% (in term of calcium) and a base number of 400 and (B2) the overbased calcium sulfonate having a calcium concentration of 10% (in term of calcium) and a base number of 300.

Orthophosphates of the component C were tricresyl phosphate having a phosphorus concentration of 8.09% (in terms of phosphorus), di-2-ethylhexyl acid phosphate having a phosphorus concentration of 9.39% (in terms of phosphorus) and phosphite diester having a phosphorus concentration of 1.31% (in terms of phosphorus).

Additives were an antioxidant, a dispersant, a copper deactivator, a viscosity index improver and anti-foaming agent.

Comparatives used: phosphite ester in place of the component C in the above exemplary embodiment (Comparative 1); neutral calcium sulfonate in place of the component B: the overbased calcium sulfonates, in the above exemplary embodiment (Comparative 2); a composition having insufficient calcium concentration and phosphorus concentration (Comparative 3); a composition having an adjusted ratio between calcium concentration and phosphorus concentration (Comparative 4); and a composition having no phosphorus (Comparative 5).

TABLE 1

| | Examples | | | Comparatives | | | | |
|---|---|---|---|---|---|---|---|---|
| contents (%) | 1 | 2 | 3 | 1 | 2 | 3 | 4 | 5 |
| 90N mineral oil | 84.8 | 84.0 | 84.7 | 83.3 | 83.4 | 85.48 | 79.8 | 85.3 |
| overbased Ca sulfonate (B1) | 0.2 | 0.2 | 0.4 | 0.4 | 0 | 0.2 | 0.4 | 0.4 |
| overbased Ca sulfonate (B2) | 0.2 | 0.2 | | | | | | |
| NCa sulfonate | | | | | 2 | | | |
| tricresyl phosphate | | 0.3 | 0.6 | | 0.3 | 0.02 | | 0 |
| di-acid phosphate | 0.5 | | | | | | 3.5 | |
| phosphorous acid | 0 | 1 | 0 | 2 | | | 2 | |
| other additives | 14.3 | 14.3 | 14.3 | 14.3 | 14.3 | 14.3 | 14.3 | 14.3 |
| total | 100 | 100 | 100 | 100 | 100 | 100 | 100 | 100 |
| friction coefficient | 0.133 | 0.126 | 0.13 | 0.105 | 0.11 | 0.098 | 0.127 | 0.095 |
| specific wear rate ($mm^3/N \cdot m \times 10^{-8}$) | 1.2 | 0.9 | 1.0 | 1.2 | 2.5 | 1.5 | 2.8 | 0.9 |
| Ca (mass ppm) | 539 | 539 | 539 | 539 | 400 | 250 | 539 | 539 |
| P derived from orthophosphates (mass ppm) | 470 | 250 | 520 | | 250 | 20 | 3500 | 0 |
| P derived from phosphorous acid (mass ppm) | | 240 | | 240 | | | 240 | 0 |

(Properties Test)

Properties tests were conducted for each of Examples 1 to 3 and Comparatives 1 to 5 shown in Table 1. A friction coefficient and a specific wear rate were measured in the properties tests. Results of the measurement are shown in Table 1.

(1) Measurement of Friction Coefficient

For measuring the friction coefficient, experiments were carried out using a Block-on-Ring Test Machine (manufactured by Falex Corporation) under the following friction conditions to measure all friction coefficients at a predetermined slip speed after five minutes. Used test pieces below were based on ASTM D-3704-78.

Load: 1200N

Oil Temperature: 100 degrees C.

Test Piece: Ring; Ni—Mo steel (SAE4620 Steel)

Block; cold work tool steel (SAE01 Steel)

Slip Speed: 0.5 m/s

Slip Distance: 1,000 m (2) Measurement of Specific Wear Rate

A specific wear rate was measured based on wear volume of the block under the above conditions.

(3) Results

Comparative 5 did not contain phosphorus. In Comparative 5, sufficient wear resistance is exhibited while the friction coefficient is extremely low. Comparative 5 confirms that the component B forms a lubricating film of wear resistance on a friction surface. Comparative 5 also indicates that the additives, on which the invention is partially based, form a protective film. In Example 3 formed by adding the component C to Comparative 5, a favorable specific wear rate is exhibited while a friction coefficient is high. Accordingly, it can be realized that addition of the components B and C is essential for achieving a high friction coefficient and wear resistance, which is the object of the invention.

Comparative 1 used phosphorous acid in place of the component C. In Comparative 1, a specific wear rate is favorable, but a friction coefficient is low. In contrast, Example 1, which used tricresyl phosphate of the component C, exhibits a favorable specific wear rate as well as a high friction coefficient.

Comparative 2 used neutral calcium sulfonate in place of the component B. In Comparative 2, a friction coefficient reaches its target level, but a specific wear rate is large. In contrast, Example 2, which contains the overbased sulfonate of the component B, exhibits a high friction coefficient as well as a target specific wear rate.

In Comparative 3, the content of the component C was less than a lower limit value. In Comparative 3, a specific wear rate reaches its target level, but a friction coefficient is lower than its target level. In contrast, by the component C being added in such a range as defined by the invention (Examples 2 and 3), a target high friction coefficient and a target specific wear rate were obtained.

In Comparative 4, the component C of more than an upper limit value was excessively mixed. In Comparative 4, a friction coefficient is high, but a specific wear rate is higher than its target level. In contrast, by the component C being added in such a range as defined by the invention (Example 1), a target high friction coefficient and a target specific wear rate were obtained.

INDUSTRIAL APPLICABILITY

The invention is applicable as a lubricating oil composition used for various continuously variable transmissions of a metallic belt type, a chain type, a traction drive type and the like.

The invention claimed is:

1. A lubricating oil composition suitable for a continuously variable transmission, comprising:

a lubricating base oil;

an overbased calcium sulfonate having a base number of 280 mgKOH/g to 500 mgKOH/g; and orthophosphate of 0.03-mass % to 3 mass % of a total amount of the lubricating oil composition, wherein the lubricating base oil is at least one of a mineral oil and a synthetic oil, wherein the lubricating base oil has a saturated hydrocarbon component of 90 mass % or more, a sulfur component of 0.03 mass % or less and the viscosity index of 100 or more, wherein the overbased calcium sulfonate is present in a calcium concentration of 300 mass ppm to 600 mass ppm of the total amount of the lubricating oil composition, the overbased calcium sulfonate is present in a calcium concentration of 0.5 to 1.2 times of a total phosphorous concentration of the lubricating oil composition, wherein the overbased calcium sulfonate is a combination of a plurality of overbased calcium sulfonates having different base numbers so that the overbased calcium sulfonate exhibits a total base number of 280 mgKOH/g to 500 mgKOH/g, and each of the plurality of overbased calcium sulfonates has different base numbers ranging from 280 mgKOH/g to 500 mgKOH/g.

2. The lubricating oil composition suitable for the continuously variable transmission according to claim 1, wherein the orthophosphate is a phosphate or an acid phosphate.

3. The lubricating oil composition suitable for the continuously variable transmission according to claim 1, wherein the orthophosphate has a phosphorus concentration of 50 mass ppm or more.

4. The lubricating oil composition suitable for the continuously variable transmission according to claim 1, wherein the continuously variable transmission is a belt-type continuously variable transmission equipped with a metallic belt.

5. The lubricating oil composition suitable for the continuously variable transmission according to claim 1, wherein the overbased calcium sulfonate is a combination of a plurality of overbased calcium sulfonates having different base numbers so that the overbased calcium sulfonate exhibits a total base number of 290 mgKOH/g to 450 mg/KOH/g.

6. The lubricating oil composition suitable for the continuously variable transmission according to claim 1, wherein the orthophosphate has a phosphorous concentration of 150 mass ppm to 1000 mass ppm.

* * * * *